United States Patent [19]

Spinner

[11] Patent Number: 4,584,446

[45] Date of Patent: Apr. 22, 1986

[54] RADIO FREQUENCY COAXIAL SWITCH

[76] Inventor: Georg Spinner, Am Eichberg 12, D-8152 Feldkirchen-Westerham 1, Fed. Rep. of Germany

[21] Appl. No.: 644,776

[22] Filed: Aug. 27, 1984

[30] Foreign Application Priority Data

Aug. 26, 1983 [DE] Fed. Rep. of Germany ..... 3330876

[51] Int. Cl.[4] ..... H01H 19/10

[52] U.S. Cl. ..... 200/153 S; 200/277

[58] Field of Search ..... 200/153 S, 277, 254, 200/255

[56] References Cited

U.S. PATENT DOCUMENTS 1,183,376 5/1916 Hansen ..... 200/277
2,601,372 6/1952 Creaser, Jr. ..... 200/153 S
3,181,086 4/1965 McCutcheon et al. ..... 200/153 S
3,246,089 4/1966 Lieberman et al. ..... 200/277

FOREIGN PATENT DOCUMENTS 341723 2/1920 Fed. Rep. of Germany ... 200/153 S
1938777 2/1971 Fed. Rep. of Germany ... 200/153 S

*Primary Examiner*—Stephen Marcus
*Assistant Examiner*—Renee S. Kidorf
*Attorney, Agent, or Firm*—Henry M. Feiereisen

[57] ABSTRACT

A radio frequency coaxial switch includes a movable contact piece and at least one stationary contact roll which is supported at one end portion of a leaf spring. The other end of the leaf spring is connected to an inner conductor of an associated coaxial connection. The leaf spring prestresses the contact roll in direction of the movable contact piece so as to guarantee a secure contact between these parts.

14 Claims, 14 Drawing Figures

RADIO FREQUENCY COAXIAL SWITCH

FIELD OF THE INVENTION

The present invention relates to a radio-frequency, especially high-frequency coaxial switch.

BACKGROUND OF THE INVENTION

The U.S. Pat. No. 4,206,332 describes a radio-frequency coaxial switch which includes at least one movable contact piece and a stationary contact arrangement having a contact element supported at one extremity of a compression spring. The other extremity of the spring is connected to an inner conductor of the associated coaxial connection. The contact element, prestressed by the compression spring in the direction of the movable contact piece, consists of a sleeve which surrounds the inner conductor and the compression spring and is resiliently supported on the front face of the movable contact piece or stud.

The German Pat. No. 341,723 describes a conventional rotary switch in which the stationary contact element is constituted by contact drums upon which compression springs act. The contact drums cooperate with the contact pieces which are arranged in a locked fashion on a switch rotor.

The use of contact drums in radio-frequency switches is known from the U.S. Pat. No. 3,394,324. In this prior art, the contact drums are not provided as a contact element arranged at one extremity of a stationary contact piece but instead constitute the movable part.

The U.S. Pat. No. 2,951,925 describes a radio-frequency coaxial switch which utilizes a contact element in the form of a leaf spring which extends the inner conductor of an associated coaxial connector and is prestressed in direction toward the movable part.

The German published specification No. 1 938 77 illustrates a radio-frequency switch which includes a switch rotor used as a movable contact piece which is contacted on both sides thereof.

From the U.S. Pat. No. 1,740,640 a knife switch with contact rolls is known which in order to obtain a contact engages in corresponding recesses of the contact blade.

OBJECT OF THE INVENTION

It is the primary object of the invention to provide an improved radio-frequency coaxial switch which requires a relatively low switching force especially for separating the contacts even if a substantial contact force is necessitated for obtaining low transfer resistances.

SUMMARY OF THE INVENTION

This object is realized according to the invention by using a leaf spring which supports at one end portion a contact roll and prestresses the contact roll in direction towards a movable contact piece.

Such a radio frequency coaxial switch has only a few and shaped parts which are uncomplicated and which can easily be correctly dimensioned to guarantee a rolling friction between the stationary part and the movable contact piece. Through the use of such a leaf spring, the required force to drive the movable part and to provide a sufficient contact is considerably reduced, thus leading to an increased durability of the switch.

The contact roll can easily be supported on the spring by providing the end portion of the latter with a semi-circular shape. It is preferable, however, to clamp the contact roll between two washers and to deform the still projecting section of the leaf spring so as to simply prevent an axial displacement of the contact roll.

According to a further feature of the invention, a stop member is provided in the vicinity of the end portion of the leaf spring to limit the deflection during assembly of the coaxial switch thereof.

The leaf spring may be provided in various embodiments. Thus it is possible to use a slotted leaf spring which carries at the end portion of each shank a contact roll or the use of a two-legged leaf spring whose shanks are dihedral about 90% with respect to each other.

A flat construction of the switch is obtained when the contact roll moves along a plane surface of the contact piece or along a ring segment shaped circumference of the contact piece. In the latter case the roll smoothly rolls up and down with respect to the movable contact piece. Both these constructions allow a contact of both sides of the movable piece by a contact roll.

A further feature of the invention resides in the fact that the movable contact piece which is either rotatable or linearly movable is at a higher level relative to the stationary contact roll so that the housing of the switch can provide a shielding between the stationary contact piece and the movable contact piece.

BRIEF DESCRIPTION OF THE DRAWING

The above and other features of the present invention will now be described in detail with reference to the accompanying drawings in which.

SPECIFIC DESCRIPTION

Figures 1, 2A, 2B, 3, 3A, 4, 4A, 5, 5A, 6, 6A:
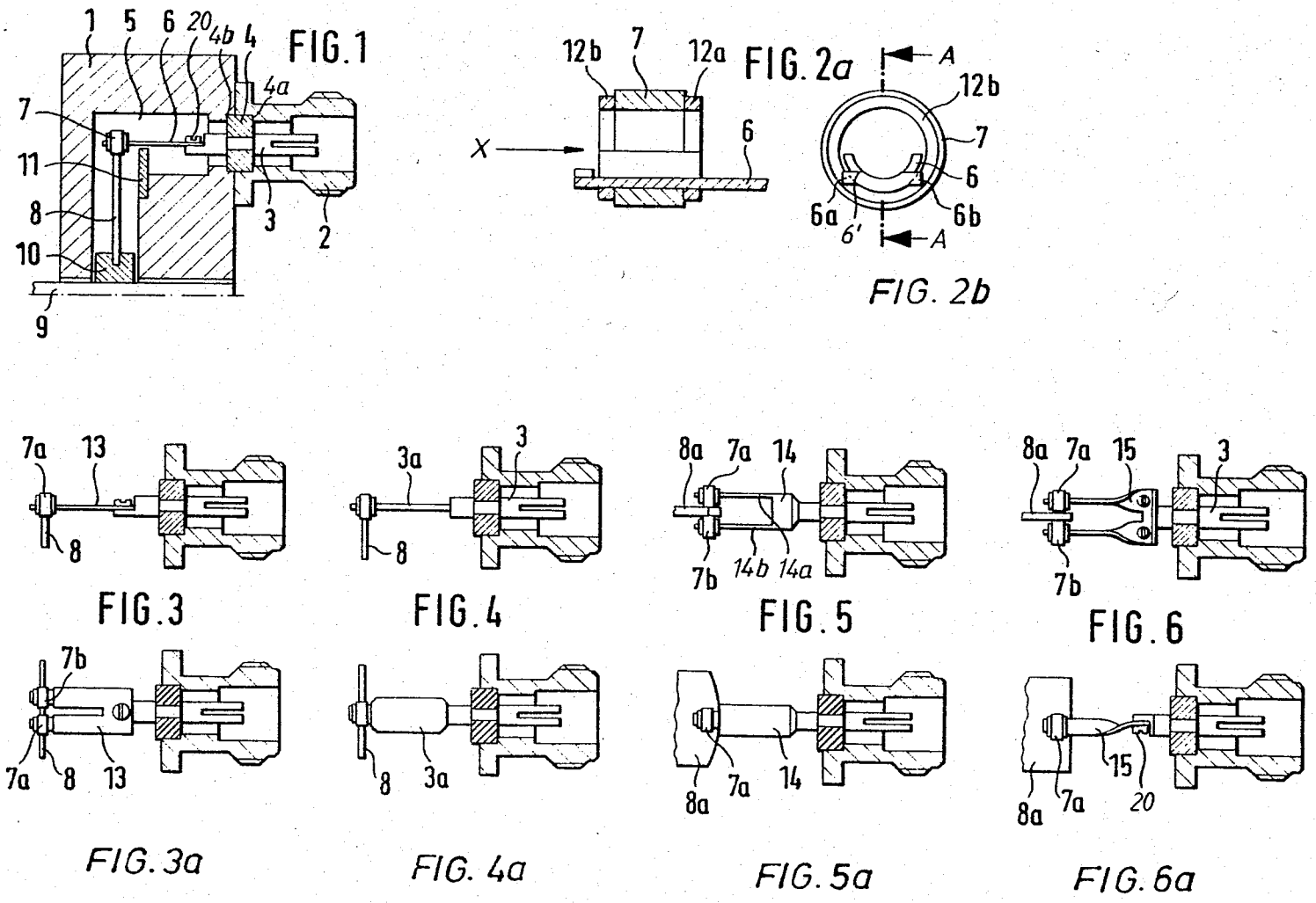
FIG. 1 is a first embodiment of a coaxial switch according to the invention.
FIG. 2*a* is a sectional view taken along lines A—A in FIG. 2*b;*
FIG. 2*b* is a sectional view of the contact roll taken in direction of arrow X according to FIG. 2*a;*
FIGS. 3 and 3*a* illustrate a second embodiment of the coaxial switch.
FIGS. 4 and 4*a* illustrate a third embodiment of the coaxial switch.
FIGS. 5 and 5*a* illustrate a fourth embodiment of the coaxial switch.
FIGS. 6 and 6*a* illustrate a fifth embodiment of the coaxial switch.

Referring first to FIG. 1, I have shown a coaxial switch including a casing 1 which serves as an outer conductor, and at one lateral face is provided with a coaxial connection 2. The housing 1 accommodates a switch chamber 5 in which one end of an inner conductor 3 projects. The inner conductor 3 is traversing the connection 2 and is kept in position by an insulating disk 4 disposed in a respective recess 4*a* of the connector 2 and a recess 4*b* of the casing 1.

The extremity of the inner conductor 3 projecting into the switch chamber 5 supports one end of a leaf spring 6 by means of a fastening element 20. The other end of the leaf spring 6 carries a contact roll 7. The leaf spring 6 and the contact roll 7 constitute a stationary contact stud which cooperates with a movable contact stud 8. In order to provide an exact switch position, the contact stud 8 is provided with a recess (not shown) in which the contact roll 7 is supported under prestress provided by the leaf spring 6. The contact stud 8 is driven by a switch rotor 10 which is arranged on a shaft 9. To limit the deflection of the leaf spring 6 during assembly of the coaxial switch a stop member 11 is located at the inner wall of the switch chamber 5 and projects transversely to the elongation of the spring 6. The use of the stop member 11 facilitates the assembly of the coaxial switch, especially of the switch rotor 10 and the movable contact stud 8 without having any interference from the spring 6, even in case the latter is provided with a substantial prestress. The stop member 11 is made of a sufficiently low-loss plastic material and fixed by any suitable means, e.g., caulking, wedging, rolling, etc.

The end of the leaf spring carrying the contact roll 7 is of semi-circular shape (FIG. 2*b*) and is provided with short transverse slots 6' opposing each other. The fixation of the contact roll 7 on the leaf spring 6, is obtained by placing the roll 7 on the spring 6 between two cylindrical washers 12*a*, 12*b* in such a manner that the portion of the spring 6 provided with the slots 6' projects beyond the foremost washer 12*b*. The spring is then bent outwardly along the slots 6' to provide outwardly extending lugs 6*a*, 6*b*. Consequently, lugs 6*a*, 6*b* as well as the force exerted by the forward portion of the spring 6 on the roll 7 prevent an axial movement of the roll 7.

For improving the contact between the stationary portion and the contact stud 8, a slotted leaf spring 13 is provided which is fixed in like manner to the inner conductor 3 and whose end of each shank carries a contact roll 7*a*, 7*b* (FIG. 3*a*). The rolls 7*a*, 7*b* are fixed to the shanks in the same manner as described with respect to the contact roll 7, and thus are rotatably connected but prevented from any axial movement.

In the embodiments according to FIGS. 1 and 3, the spring is screwed on the inner conductor 3. It is, however, possible to provide the spring in one piece with the conductor 3 as illustrated, for example, in FIG. 4, in which a leaf spring 3*a* is integrally connected to the conductor 3.

In FIGS. 5*a* and 5*b* a contact piece 8*a* is illustrated which is shaped in the form of a blade and cooperates with a leaf spring 14 provided with two shanks 14*a*, 14*b*. Shanks 14*a*, 14*b* are elastically prestressed against each other and each supports respective contact rolls 7*a*, 7*b* at its extremity which is remote to the inner conductor 3.

A further embodiment is shown in FIGS. 6*a*, 6*b*, in which the stationary contact piece includes a two-legged leaf spring 15 whose shanks are arranged dihedrally about an angle of 90% with respect to each other. The connection between the spring 15 and the conductor 3 is achieved with a screw 20.

In the embodiments according to FIGS. 5 and 6, it can be seen that the contact rolls 7*a*, 7*b* are in contact with a respective side of the movable piece 8. Advantageously, the surface of each side of the contact piece 8 is provided in a plane manner to support the contact rolls 7*a*, 7*b* when the contact piece 8 is rotated or moved in a linear direction so that both embodiments a relatively flat construction is obtained.

Figure 7:
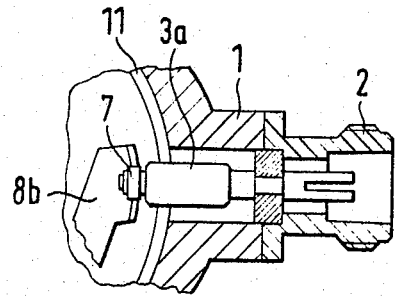
FIGS. 7 and 7*a* illustrate a sixth embodiment of the coaxial switch.
Figure 7A:
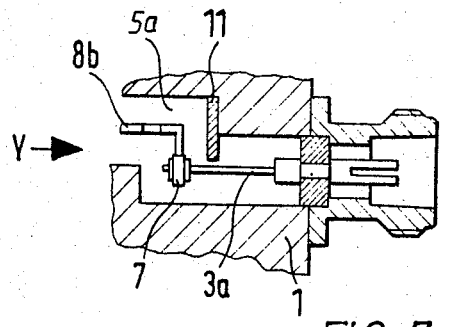
Figure 7B:
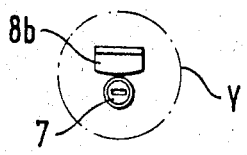
FIG. 7*b* is a view taken in direction of arrow Y according to FIG. 7*a.*

The embodiment shown in FIGS. 7, 7*a*, 7*b* is especially advantageous with respect to a disengagement of the stationary contact arrangement from the movable contact piece 8 when contact is opened. The stationary contact arrangement corresponds to the one as shown and described in reference to FIG. 4. In contrast thereto, however, a movable contact stud 8*b* is provided which at its conducting end is angled towards the contact roll 7 in an L-shaped manner. The housing 1 accommodates a switch chamber 5*a* which is adpated to the shape of the contact piece 8*b* and thus is also of L-shape so that the movable contact piece 8*b* is arranged at a higher level with respect to the plane of the conductor 3, spring 3*a* and roll 7. Consequently, the housing 1 which constitutes the outer conductor provides a shielding between the stationary and movable contact piece with the contacts are open. In this embodiment, a stop member 11 corresponding to the one described in connection with the coaxial switch of FIG. 1 is provided at a suitable location at the inner wall of the switch chamber 5*a* to limit the deflection of the leaf spring 3*a* during assembly of the coaxial switch.

As can be seen from FIG. 7*b*, the movable piece 8*b* has a ring segment-shaped circumference so that the movement of the roll 7 along the circumference is facilitated.

I claim:

1. A coaxial switch, comprising:

a casing accommodating a chamber;

a movable contact member arranged in said chamber;

at least one stationary contact roll cooperating with said movable contact member;

a leaf spring having one end portion supporting said contact roll and prestressing the latter toward said movable contact member; and connecting means for positioning said contact roll on said end portion of said leaf spring.

2. A coaxial switch as defined in claim 1 wherein said connecting means include at least two washers, said contact roll being arranged on said end portion clamped between said washers.

3. A coaxial switch as defined in claim 2 wherein said end portion has a section projecting beyond said washers and said contact roll clamped therebetween, said section being deformed so as to prevent an axial movement of said contact roll.

4. A coaxial switch as defined in claim 3 wherein said section of said leaf spring is semi-circularly shaped.

5. A coaxial switch as defined in claim 4 wherein said section is provied with at least one transverse slot along which the deformation is obtained.

6. A coaxial switch as defined in claim 1 wherein said contact member is provied with a recess in whcih said contact roll rests upon contacting said member.

7. A coaxial switch as defined in claim 1 wherein said leaf spring is slotted so as to have two shanks, each of said shanks having an end portion supporting one such contact roll.

8. A coaxial switch as defined in claim 1, and further comprising an inner conductor integrally connected with the other end portion of said leaf spring.

9. A coaxial switch as defined in claim 1 wherein said movable contact member has a plane contact surface on which said contact roll is moved to provide a contact.

10. A coaxial switch as defined in claim 1 wherein said movable contact member has a ring-shaped circumference segment so as to facilitate the runing up and down of said contact member along said contact roll.

11. A coaxial switch as defined in claim 1 wherein said movable contact member has an angular shape angling toward said contact roll.

12. A coaxial switch as defined in claim 11 wherein said movable contact member is arranged within said chamber at a higher level with respect to said stationary contact roll so that said casing provides a shielding function.

13. A coaxial switch as defined in claim 12 wherein said movable contact member is L-shaped, said chamber of each casing being adapted to the shape of each member so as to be of an L-shape as well.

14. A coaxial switch as defined in claim 1, and further comprising a stop member arranged at a distance to said end portion of said leaf spring for limiting the deflection of the latter.

* * * * *